US010794019B2

(12) United States Patent
Risi

(10) Patent No.: US 10,794,019 B2
(45) Date of Patent: Oct. 6, 2020

(54) APPARATUS AND ASSEMBLY FOR EXCAVATION

(71) Applicant: SIMEX S.R.L., San Giovanni in Persiceto, Bolonga (IT)

(72) Inventor: Micro Risi, Bologna (IT)

(73) Assignee: SIMEX S.R.L., San Giovanni in Persiceto, Bologna (IT)

( * ) Notice: Subject to any disclaimer, the term of this patent is extended or adjusted under 35 U.S.C. 154(b) by 0 days.

(21) Appl. No.: 16/453,443

(22) Filed: Jun. 26, 2019

(65) Prior Publication Data

US 2020/0002903 A1 Jan. 2, 2020

(30) Foreign Application Priority Data

Jun. 29, 2018 (IT) ..... 10201806830

(51) Int. Cl.
*E01C 23/088* (2006.01)

(52) U.S. Cl.
CPC ..... *E01C 23/088* (2013.01)

(58) Field of Classification Search
CPC ..... E01C 23/088; E01C 23/09; E01C 23/12
USPC ..... 404/93, 94; 299/39.1, 39.4, 39.6
See application file for complete search history.

(56) References Cited

U.S. PATENT DOCUMENTS 8,002,360 B2 * 8/2011 Cochran ..... E01C 23/088 299/39.4
2009/0232598 A1 9/2009 Cochran et al.

FOREIGN PATENT DOCUMENTS

JP H10-140519 A 5/1998

OTHER PUBLICATIONS

Italian Search Report for corresponding Italian Patent Application No. 102018000006830 dated Feb. 8, 2019, 3 pages.

* cited by examiner

*Primary Examiner* — Sunil Singh
(74) *Attorney, Agent, or Firm* — Merchant & Gould P.C.

(57) ABSTRACT

An excavation apparatus (1) for an operating machine includes an apparatus body (2) having a portion (4) for coupling to the operating machine and delimiting a first body compartment (6). An excavation tool (8) of the apparatus (1) is partly housed, rotating around a rotation axis. A self-leveling body (10) includes a pair of abutment runners (12, 14) with a working surface (Z) and rotatably mounted in an idle manner with respect to the apparatus body (2), so the coupling portion (4) assumes different angular positions with respect to the abutment runners (12, 14). The apparatus body (2) is mechanically connected to the self-leveling body (10) to weigh in a balanced manner on the transverse walls (16, 18) and on the abutment runners (12, 14).

15 Claims, 6 Drawing Sheets

APPARATUS AND ASSEMBLY FOR EXCAVATION

This application claims benefit of Ser. No. 102018000006830, filed 29 Jun. 2018 in Italy and which application is incorporated herein by reference. To the extent appropriate, a claim of priority is made to the above disclosed application.

BACKGROUND OF THE INVENTION

The present invention concerns an excavation apparatus for an operating machine, and an operating machine comprising such apparatus.

The use of excavation devices that may be connected to excavators for the construction of trenches, or for the removal of layers of asphalt or the like, is well known.

A problem felt in this sector is the functional reliability over time, as the drums or the excavation wheels of the apparatuses are traditionally subjected to enormous stresses (in particular of the flexural type), which could compromise their operation in an exaggeratedly short life cycle.

SUMMARY OF THE INVENTION

The present invention is part of the preceding context, proposing to provide an excavation apparatus and an operating machine capable of overcoming the drawbacks reported.

In particular, this apparatus is of high strength and allows the excavation forces to be discharged in a balanced way on the mechanical components in order to reduce the effects of wear.

BRIEF DESCRIPTION OF THE DRAWINGS

The object of the present invention will now be described in detail, with the aid of the figures, provided by way of illustrative and non-limiting example, wherein.

DETAILED DESCRIPTION OF THE PREFERRED EMBODIMENTS

Figure 1:
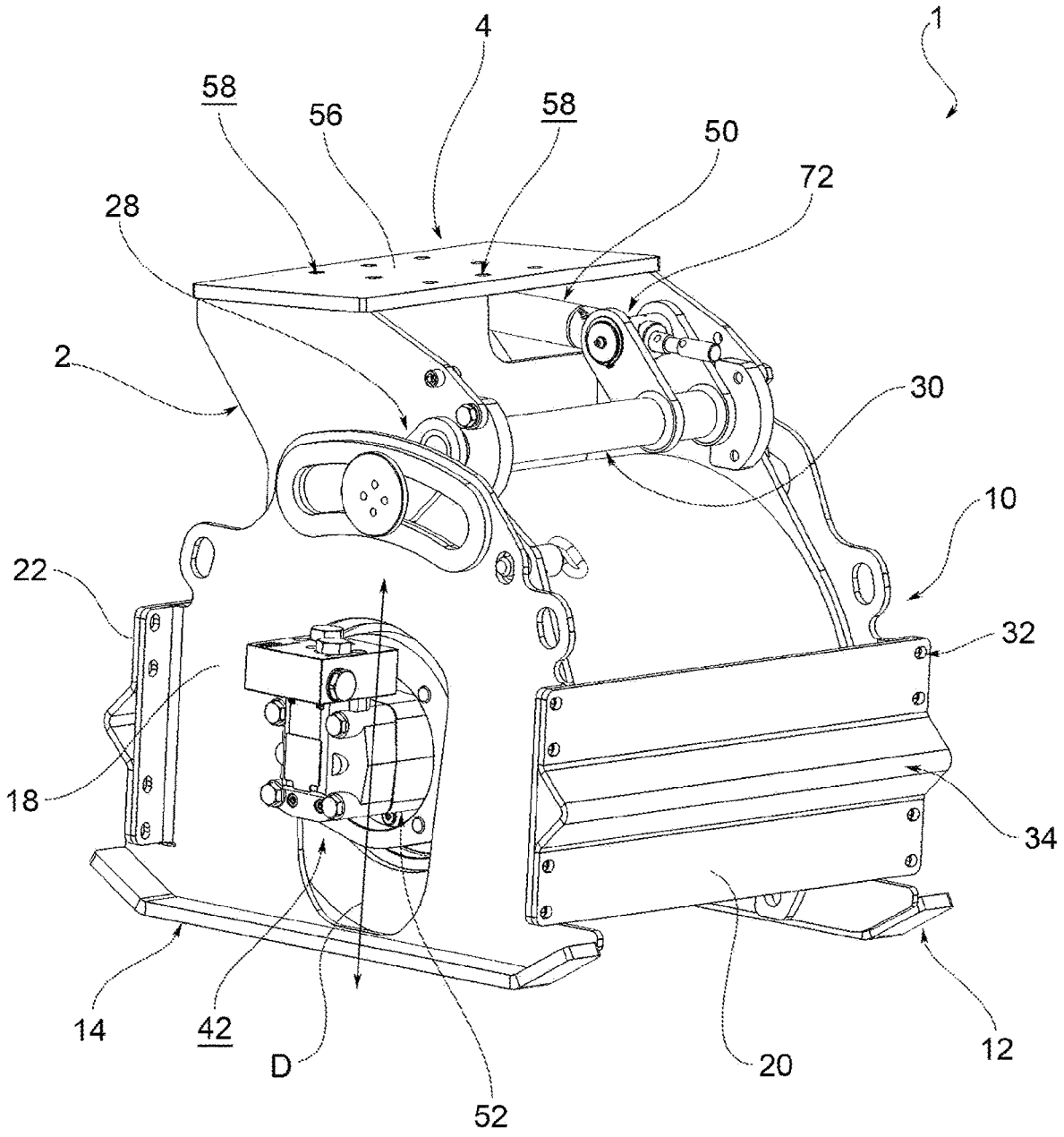
FIGS. 1, 2 show perspective views from opposite sides of an assembly, object of the present invention, according to a possible embodiment.
Figure 2:
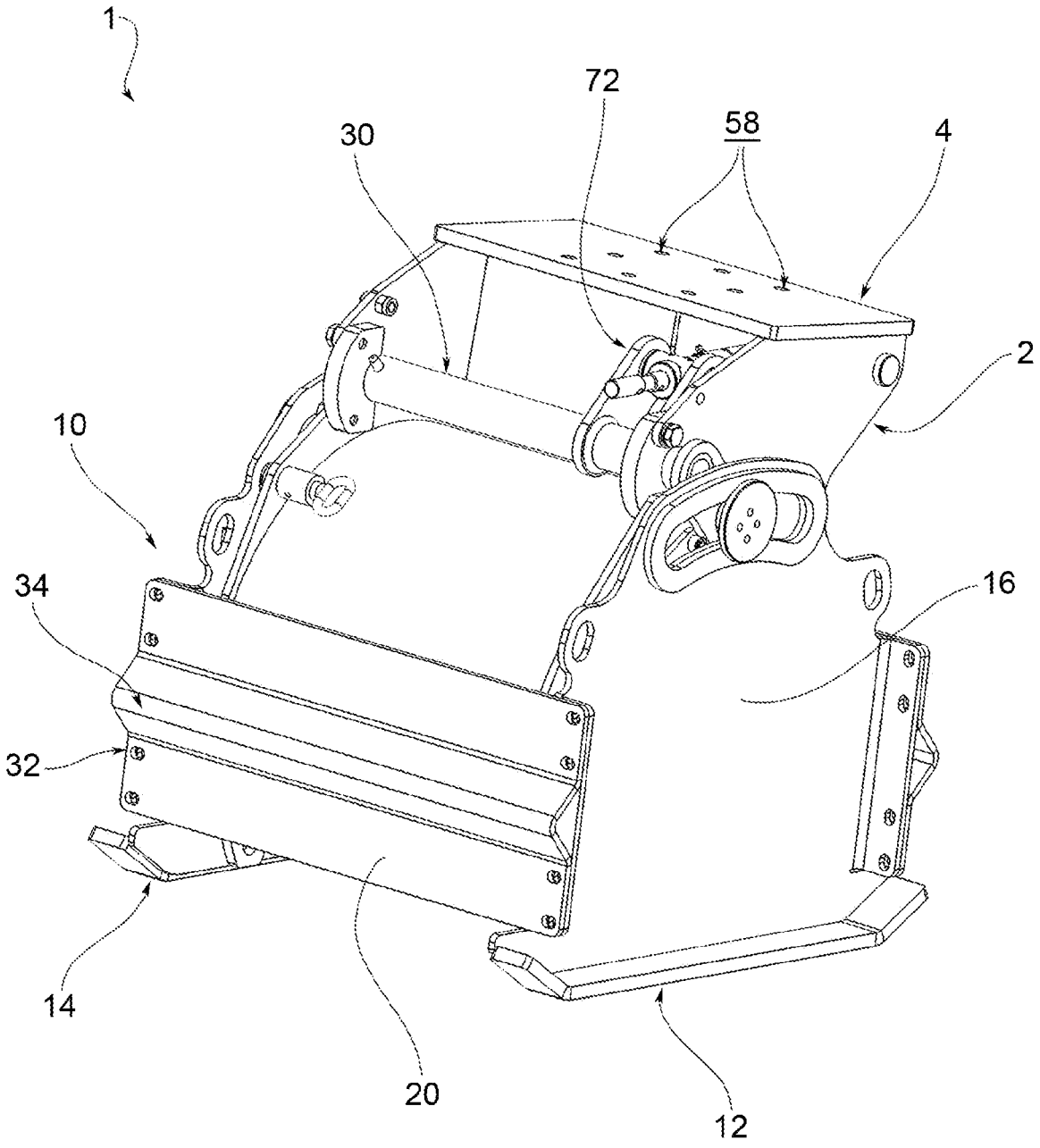
Figure 3:
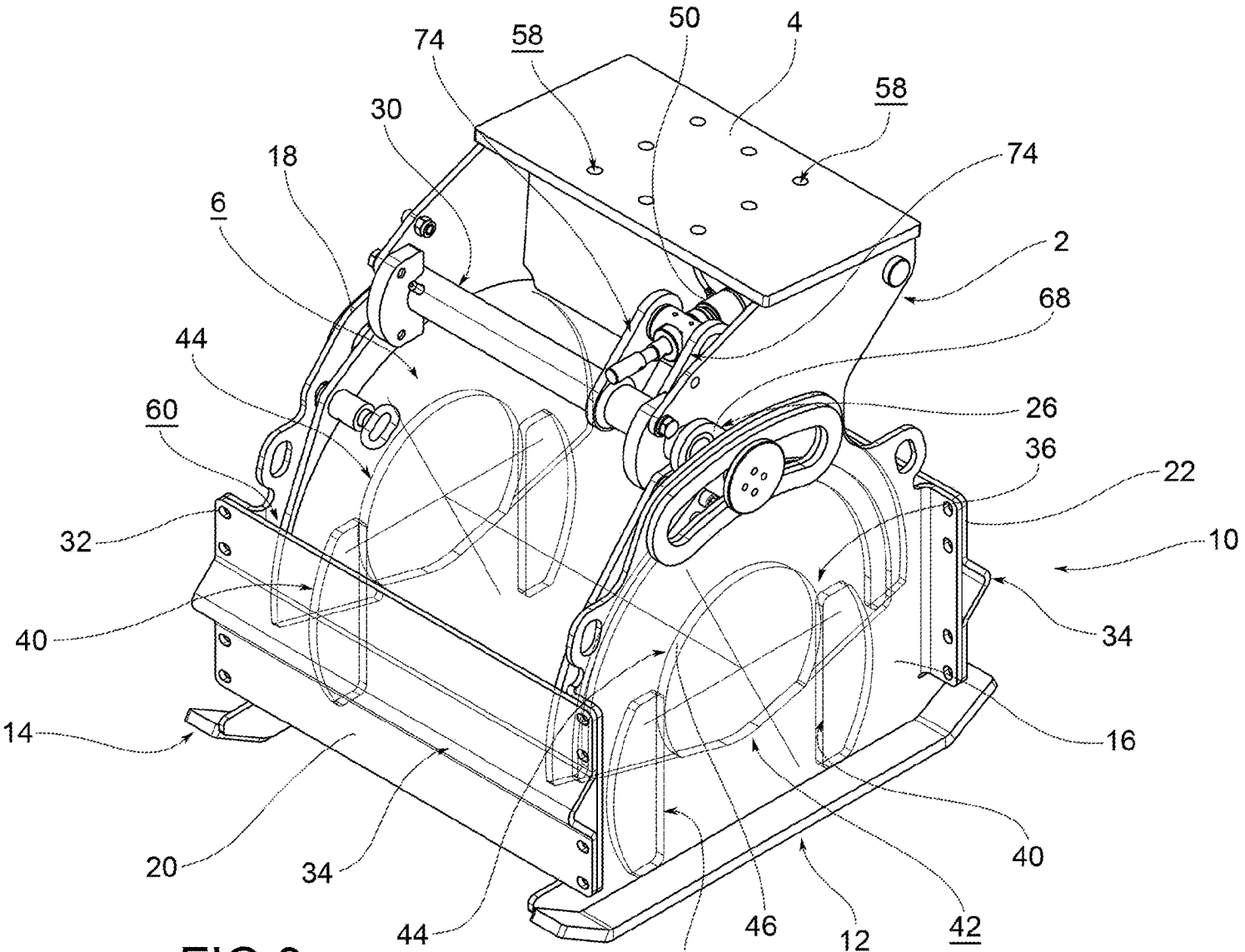
FIG. 3 illustrates a front perspective view similar to the one in FIG. 2, where part of the apparatus body has been removed for greater clarity.
Figure 4:
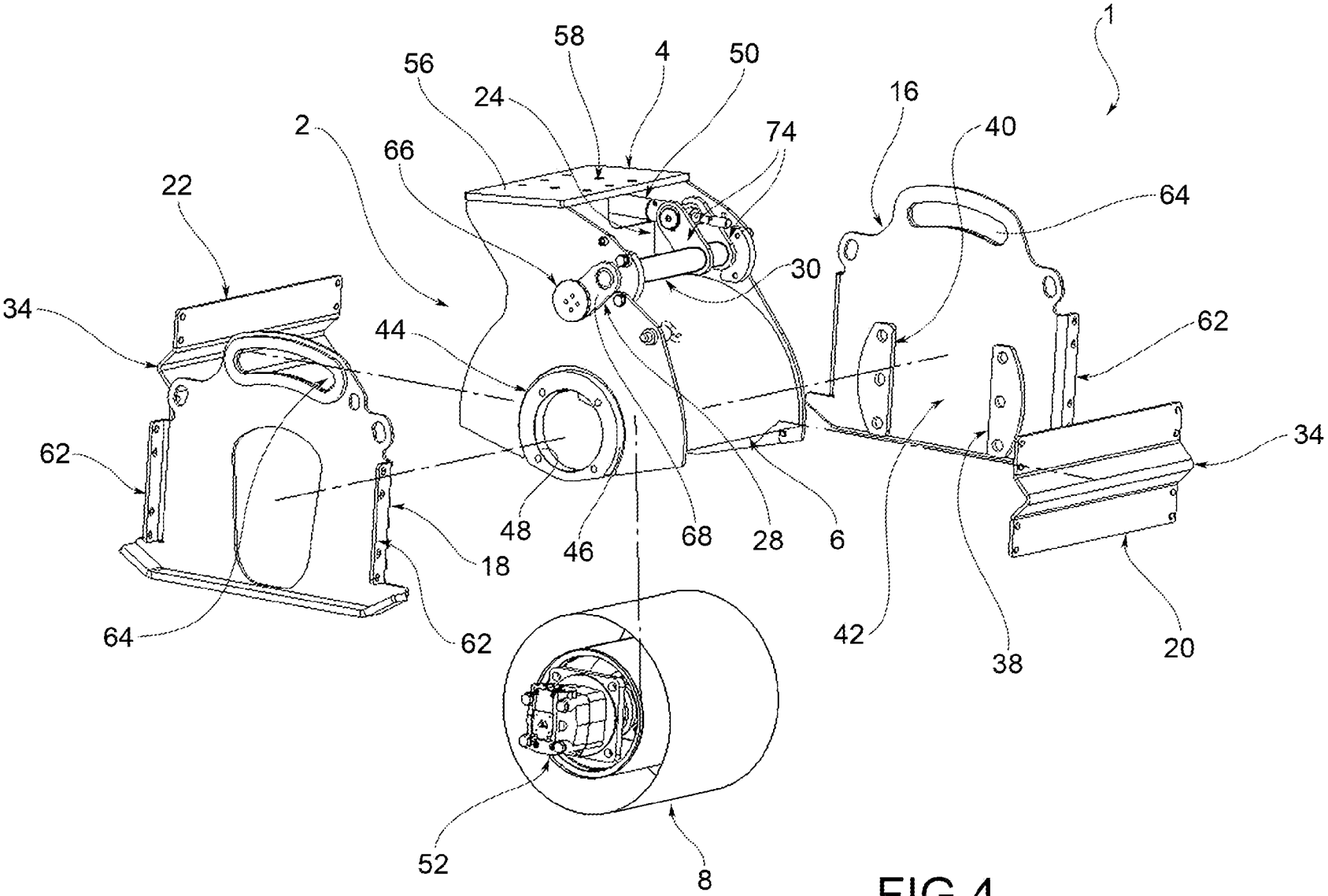
FIG. 4 represents a perspective view of the apparatus in FIG. 1, wherein the walls that make up the self-leveling body and the excavation tool are shown exploded.

With reference to the aforesaid figures, the reference number 1 indicates, in its totality, an apparatus for an operating machine.

According to one embodiment, this apparatus is an excavation apparatus.

According to one embodiment, this apparatus is a milling apparatus.

This excavation apparatus 1 comprises an apparatus body 2, a rotating excavation tool 8 and a self-leveling body 10.

According to one embodiment, the excavation tool 8 is in the form of a wheel or disc.

According to one embodiment, the excavation tool 8 is in the form of a roller or cylinder.

According to one embodiment, the excavation tool 8 comprises peripherally a plurality of excavation elements 54, for example oriented in a tangential direction with respect to a rotation axis R of such tool.

It should be noted that, unless otherwise specified, the terms "axial", "radial" or "tangential" shall always refer to the rotation axis R.

The apparatus body 2 comprises a portion 4 for coupling to the operating machine and delimits a first body compartment 6 wherein an excavation tool 8 of the apparatus 1 is partly housed.

According to one embodiment, in a plane orthogonal to the rotation axis R, the first body compartment 6 has a circular sector cross-section.

According to one embodiment, the coupling portion 4 comprises an attachment plate 56 penetrated by a plurality of attachment holes 58 for locking the apparatus 1 to the operating machine, for example to a movable arm or to a support of the latter.

The self-leveling body 10 comprises a pair of abutment runners 12, 14 with a working surface Z.

In the embodiment shown, the position of the abutment runners 12, 14 with respect to the excavation tool 8 is adjustable in a mutually dependent manner, so that the distance of these runners with respect to the excavation surface may be the same for both runners. For example, this adjustment could be achieved using a single depth adjustment device 24.

According to one embodiment, the position of the abutment runners 12, 14 with respect to the excavation tool 8 is adjustable independently, whereby the distance of each abutment runner with respect to the excavation surface may be selected independently. For example, such an adjustment could be achieved by means of a pair of adjustment devices 24, advantageously acting in parallel with each other.

According to this variant, the apparatus 1 could advantageously comprise a device 24 for adjusting the excavation depth X—as described below—for each abutment runner 12, 14.

It follows that this variant advantageously provides that the transverse walls 16, 18 may be separated from each other, so that each of these may assume a different position with respect to the apparatus body 2, for example, each through its own adjustment device 24, and thus so that one abutment runner 12, 14 is adjustable separately from the other abutment runner.

According to this variant, the apparatus 1 could advantageously be devoid of longitudinal walls 20, 22 connecting the transverse walls.

The self-leveling body 10 is rotatably mounted in an idle manner with respect to the apparatus body 2, so that the coupling portion 4 may assume different angular positions with reference to a rotation axis substantially parallel or coincident to the axis R—with respect to the abutment runners 12, 14.

Figure 6:
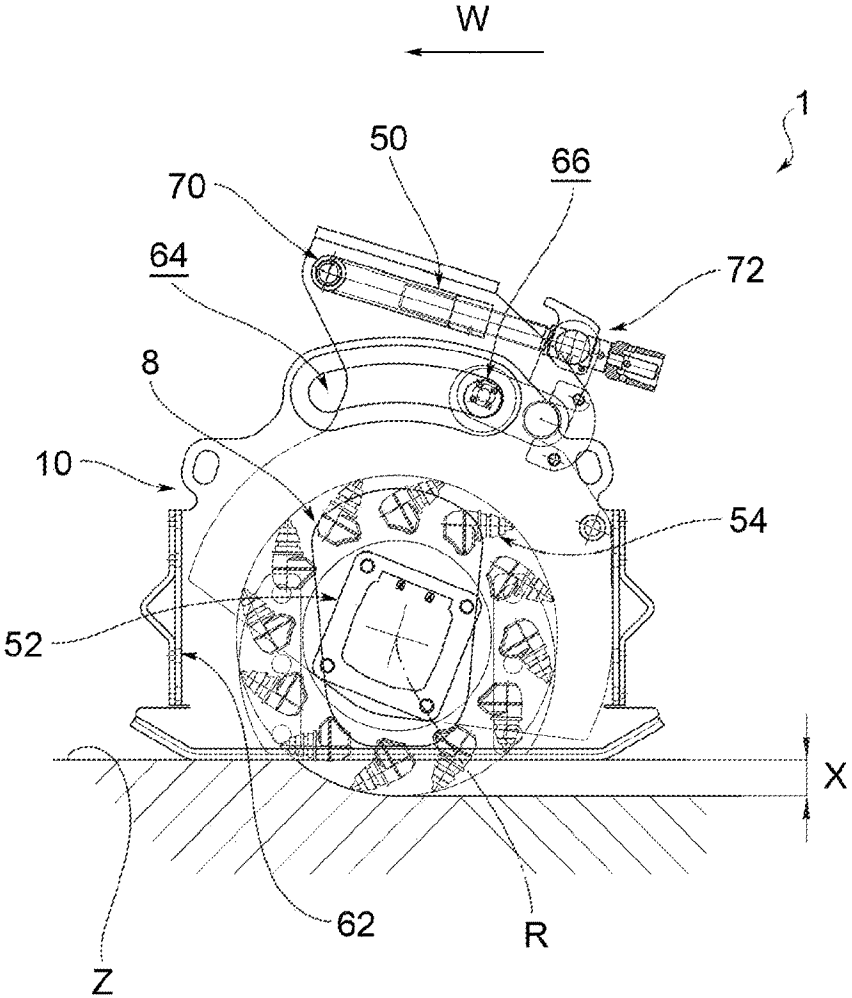
FIGS. 5, 6 illustrate lateral views of the excavation apparatus according to a variant of the present invention, in two different positions of the coupling portion with respect to the abutment runners.
Figure 5:
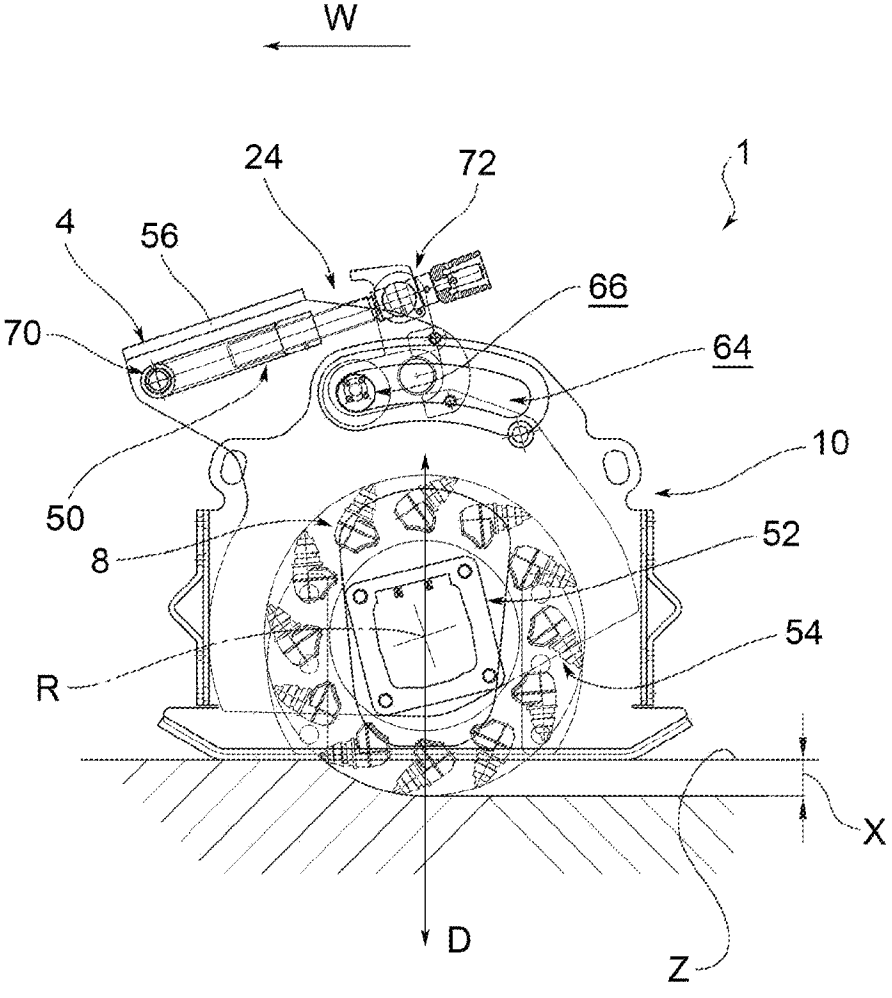

Such freedom of movement is well exemplified in FIGS. 5 and 6, wherein the coupling portion is rotated respectively to the left (in a first angular position) or to the right (in a second angular position) in a manner independent of the position of the tool and the excavation depth thereof.

It follows that the excavation apparatus 11 is designed so that the abutment runners 12, 14 always remain in contact with the working surface Z, regardless of the angular position of the coupling portion 4 (and of the arm or support of the operating machine connected thereto), specifically so that the excavation depth X remains constant or unchanged for a given excavation operation of the excavation tool 8.

According to one embodiment, the self-leveling body 10 and the apparatus body 2 may thus be rotated parallel to the rotation axis R.

According to one embodiment, the self-leveling body 10 guided by the apparatus body 2 into the different angular positions by guide means cooperating between these bodies 10, 2.

According to one embodiment, the guide means comprise at least one edge of a guide slot 64 slidably engaged by at least one guide pin 66.

According to one embodiment, the self-leveling body 10 comprises at least one pair of transverse walls 16, 18 axially offset along the rotation axis R, rigidly connected by means of a pair of longitudinal walls 20, 22 of this body 10 for delimiting a box-shaped structure housing the excavation tool 8 in a manner protruding frontally to the abutment runners 12, 14.

According to one embodiment, the self-leveling body 10 comprises at least one pair of transverse walls 16, 18 (or comprises only these walls) axially offset along the rotation axis R, connected to the apparatus 2 in a sliding manner. In this variant, the pair of transverse walls 16, 18 axially houses the excavation tool 8 protruding frontally to the abutment runners 12, 14.

Figure 7:
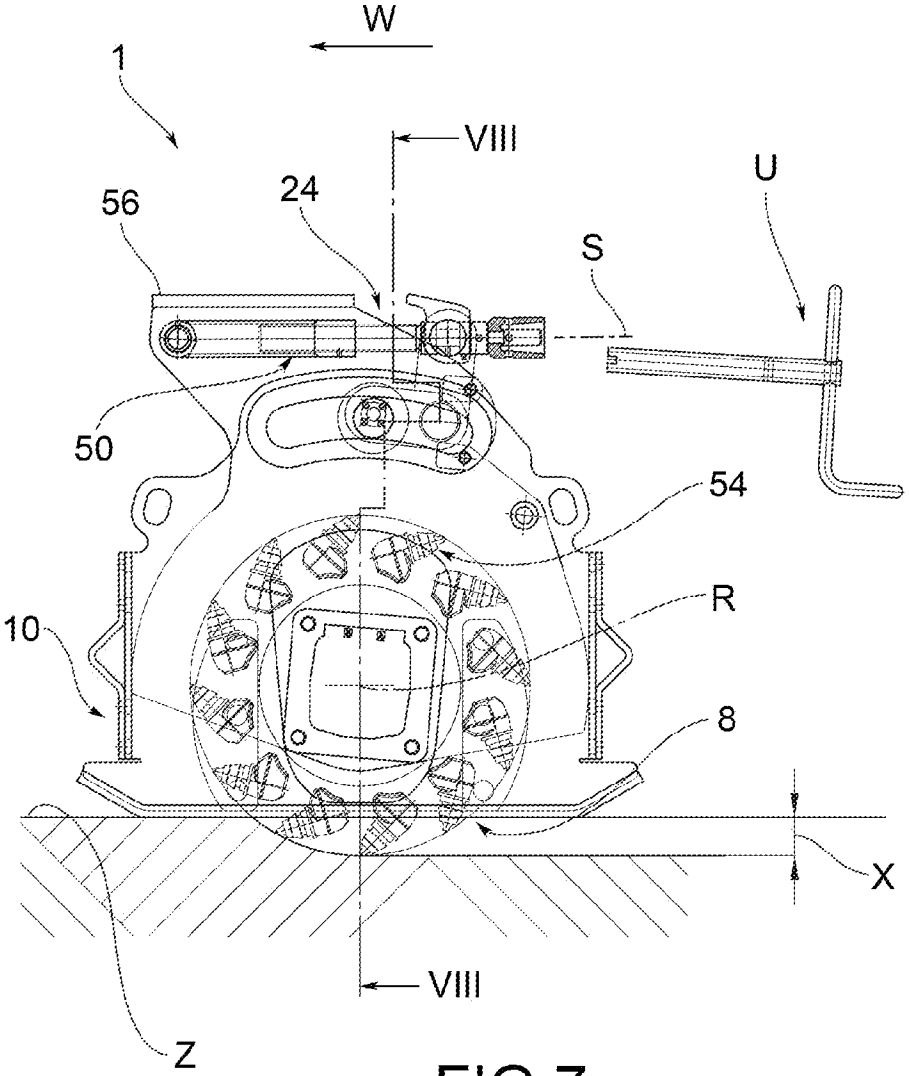
FIG. 7 shows a lateral view of the apparatus in FIG. 1, wherein is shown also an adjustment wrench or tool U that may be connected to the adjustment device.
Figure 8:
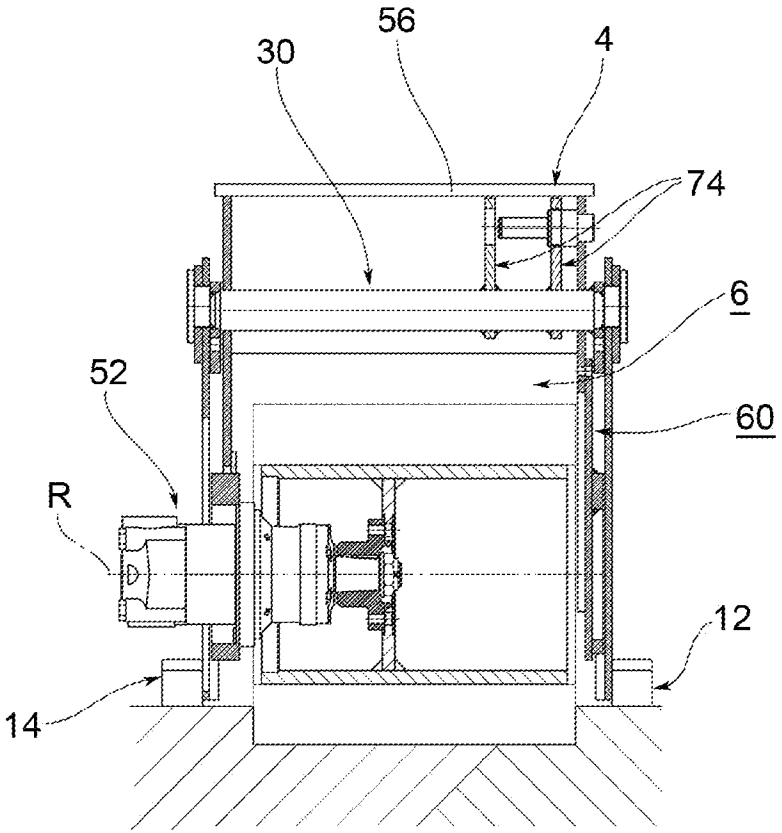
FIG. 8 illustrates a cross-sectional view of the apparatus shown in FIG. 7 along the plane VIII-VIII indicated therein.

In this way, this excavation tool 8 is able to remove or excavate a solid material from the working surface Z, for example vertically downwards according to the orientation of FIG. 6 or 7.

This device 1 may therefore be moved in one working direction W by virtue of the sliding contact between the abutment runners 12, 14 and the working surface Z.

According to one embodiment, the abutment runners 12, 14 are arranged next to the excavation tool 8.

According to one embodiment, the abutment runners 12, 14 are made from folded metal sheets.

According to one embodiment, the abutment runners 12, are made in one piece with a respective transverse wall 16, 18.

According to one embodiment, one or more transverse walls 16, 18 and/or one or more longitudinal walls 20, 22 are substantially planar.

According to one embodiment, the transverse walls 16, and the longitudinal walls 20, 22 are connected at right angles.

According to one embodiment, the transverse walls 16, 18 and the longitudinal walls 20, 22 delimit a second body compartment 60.

According to one embodiment, the apparatus body 2 is at least partly housed between the transverse walls 16, 18 and the longitudinal walls 20, 22, in particular in the second body compartment 60.

According to one embodiment, at least one longitudinal wall 20, 22 comprises structural stiffening means made in one piece with this wall 20, 22.

According to one embodiment, the stiffening means are in the form of a folded portion 24 (in particular in the radial direction) of a sheet forming at least part of that wall.

According to one embodiment, the second body compartment 60 has a substantially square or rectangular cross-section parallel to the working surface Z.

According to one embodiment, the transverse walls 16, and the longitudinal walls 20, 22 are fastened together in a monolithic manner, for example welded or joined by mechanical locking means.

According to one embodiment, the transverse walls 16, and the longitudinal walls 20, 22 are joined by welding.

According to one embodiment, the transverse walls 16, 18 and the longitudinal walls 20, 22 are joined together by mechanical locking means, for example, threaded.

According to one embodiment, one or both longitudinal walls 20, 22 may protrude axially with respect to the transverse walls 16, 18.

According to one embodiment, at least one transverse wall 16, 18 (for example both) could include at least one axial protrusion 62 (for example an opposite pair of such protrusions 62) to couple to one or both transverse walls 16, 18.

According to one embodiment, the mechanical means between the transverse walls 16, 18 and the longitudinal walls 20, 22 could be engaged at one or more axial protrusions 62.

According to one embodiment, the apparatus body 2 is mechanically connected to the self-leveling body 10 so as to weigh in a balanced manner on the transverse walls 16, 18 and on the abutment runners 12, 14.

According to one embodiment, the apparatus body 2 is connected to the self-leveling body 10 by at least one device 24 for adjusting the excavation depth X of the apparatus 1.

The function of the adjustment device 24 according to this variant is thus to modify or adjust the projection of the excavation tool 8 with respect to the abutment runners 12, 14, and thus the adjustment of the excavation depth.

It should be noted that the adjustment device 24 is operated (for example by the wrench or adjusting tool U, or pneumatically, hydraulically or mechanically) in order to determine the excavation depth X.

However, after the desired excavation depth has been established (i.e. after the least or greatest projection of the excavation tool 8 frontally with respect to the abutment runners 12, 14 has been determined), this device provides for keeping this adjustment or setting constant or unchanged throughout the given excavation operation.

According to one embodiment, the adjustment device 24 comprises adjustment elements 26, 28 acting symmetrically on the transverse walls 16, 18.

According to one embodiment, the adjustment elements 26, 28 comprise one or more first radial levers 68.

According to one embodiment, the adjustment elements 26, 28 are connected to one or more movable adjustment shafts 30 for both of these elements 26, 28 synchronously.

According to one embodiment, a single adjustment shaft is provided to which are associated or joined the adjustment elements 26, 28.

According to one embodiment, a pair of first radial levers 68 may be associated or joined to the axial ends of the adjustment shaft 30, in particular in a manner rotationally integral to this shaft.

According to one embodiment, at least one guide pin 66 may be fastened to one free end of a first radial lever 68.

According to one embodiment, the transverse walls 16, 18 and the apparatus body 2 comprise guide means 36 of the excavation tool 8 in different adjustment positions of the excavation depth X thereof.

The adjustment positions are arranged along an adjustment direction D as shown by the double arrow in FIGS. 1 and 5.

According to one embodiment, the guide means 36 comprising a pair of lateral guides 38, 40 associated with the transverse walls 16, 18 (or with the apparatus body) that delimit between them a sliding space 42, and a sliding member 44 associated with the apparatus body 2 (or with the transverse walls) housed at least in part in the sliding space 42 in a sliding manner.

According to one embodiment, the sliding member 44 is connected to the apparatus body 2.

According to one embodiment, the sliding member 44 is substantially annular in shape.

According to one embodiment, an outer annular surface 46 of the sliding member 44 is in abutment with the lateral guides.

According to one embodiment, an inner annular surface 48 of the sliding member 44 forms a rotational guide for the excavation tool 8.

According to one embodiment, the adjustment device 24 comprises a first actuator 50 (for example linear or rotational) acting in thrust or in traction between the apparatus body 2 and the self-leveling body 10, specifically in a tangential direction S with respect to a circumference centered on the rotation axis R.

According to one embodiment, the first actuator 50 is fixed at a first portion 70 to the apparatus body 2 and is fixed at a second portion 72 to the self-leveling body 10, advantageously in an articulated way at these portions 70, 72.

According to one embodiment, the first actuator 50 is mechanically connected to one or more adjustment shafts 30, for example by means of a second radial lever 74.

According to one embodiment, the second radial lever 74 is integral in rotation to one or more adjustment shafts 30 and is hinged to the first actuator 50 at one of its radial ends.

Thus, as a result of a force exerted by the actuator 50—for example, as a result of approaching or moving away from the opposite ends thereof—this actuator 50 will rotate the radial lever 74 in a direction that causes a raising or lowering of the self-leveling body 10 with respect to the apparatus body 2 (by virtue of the sliding of the guide pin 66 along the slot 64), and thus a corresponding movement of the excavation tool 8.

This adjustment device 24 has been discussed by way of example only. Other ways of adjusting the excavation depth according to other embodiments are possible.

According to one embodiment, the excavation tool 8 may be rotated with respect to the apparatus body 2 by motor means 52.

According to one embodiment, the motor means 52 are of the hydraulic type.

According to one embodiment, the motor means 52 are engaged with and are movable integrally with the excavation tool 8 in the different adjustment positions of the excavation depth X.

The aforesaid objectives are also achieved by means of an excavation assembly comprising an operating machine and an excavation apparatus 1, according to any of the embodiments illustrated above, fixed to a movable arm or support of the operating machine.

According to one embodiment, the operating machine 10 could comprise a fluidic power take-off to power the hydraulic type motor means 52.

Innovatively, the apparatus and the assembly object of the present invention are suitable to overcome successfully the drawbacks discussed previously.

More precisely, the apparatus described makes it possible to guarantee a greater solidity over time with respect to traditional apparatuses.

Advantageously, the apparatus and the assembly object of the present invention allow the flexural forces acting on the body that compose it to be reduced or eliminated.

Advantageously, the apparatus object of the present invention may be operated with fewer levers or controls with respect to traditional apparatuses.

Advantageously, the apparatus object of the present invention is constructed in a rational manner.

To the embodiments of the aforesaid apparatus and operating machine, one skilled in the art, in order to meet specific needs, may make variants or substitutions of elements with other functionally equivalent ones.

Also these variants are contained within the scope of protection as defined by the following claims.

Moreover, each variant described as belonging to a possible embodiment may be implemented independently of the other variants described.

LIST OF REFERENCE NUMBERS

1 Excavation apparatus
2 Apparatus body
4 Coupling portion
6 First body compartment
8 Excavation tool
10 Self-leveling body
12 Abutment runner
14 Abutment runner
16 Transverse wall
18 Transverse wall
20 Longitudinal wall
22 Longitudinal wall
24 Adjustment device
26 Adjustment Element
28 Adjustment Element
30 Adjustment shaft
32 Mechanical locking means
34 Folded portion
36 Guide means
38 Lateral guide
40 Lateral guide
42 Sliding space
44 Sliding member
46 Outer annular surface
48 Inner annular surface
50 First actuator
52 Motor means
54 Excavation element
56 Fastening plate
58 Attachment hole
60 Second body compartment
62 Axial protrusion
64 Guide slot
66 Guide pin
68 First radial lever
70 First portion
72 Second portion
74 Second radial lever
D Adjustment direction
X Excavation depth
R Rotation axis
S Tangential direction
U Adjustment wrench or tool
W Working direction
Z Working surface

The invention claimed is:

1. Excavation apparatus for an operating machine comprising:

an apparatus body comprising a coupling portion to the operating machine and delimiting a first body compartment wherein an excavation tool of said apparatus is partly housed, rotating around a rotation axis;

a self-leveling body, comprising a pair of abutment runners with a working surface and rotatably mounted in an idle manner with respect to the apparatus body, wherein the coupling portion is angularly adjustable with respect to the pair of abutment runners;

the self-leveling body comprises at least one pair of transverse walls are spaced apart along the rotation axis, rigidly connected by a pair of longitudinal walls of said body for delimiting a box-shaped structure housing the excavation tool protruding frontally to the pair of abutment runners;

wherein the apparatus body is mechanically connected to the self-leveling body to weigh in a balanced manner on the at least one pair of transverse walls and on the pair of abutment runners;

wherein the coupling portion is rotatable with respect to the pair of abutment runners at least in a first angular position toward the left and in a second angular position to the right with respect to a vertical direction, and wherein the coupling portion is rotatable independently of a position of the tool and an excavation depth of the tool, the vertical direction being orthogonal to the working surface and incident to the rotation axis.

2. Apparatus according to claim 1, wherein the self-leveling body is slidably connected to the apparatus body, said at least one pair of transverse walls housing axially the excavation tool protruding frontally to the pair of abutment runners.

3. Apparatus according to claim 1, wherein the apparatus body is connected to the self-leveling body by an adjustment device of an excavation depth of said apparatus comprising adjustment elements acting symmetrically on the at least one pair of transverse walls.

4. Apparatus according to claim 3, wherein the adjustment elements are connected to one or more adjustment shafts movable for both said adjustment elements in a synchronous manner.

5. Apparatus according to claim 3, wherein the adjustment device comprises a first actuator acting in thrust or in traction between the apparatus body and the self-leveling body, in a tangential direction with respect to a circumference centered on the rotation axis.

6. Apparatus according to claim 1, wherein the at least one pair of transverse walls and the pair of longitudinal walls are substantially planar, and are connected at right angles.

7. Apparatus according to claim 1, wherein the at least one pair of transverse walls and the pair of longitudinal walls are monolithically joined together.

8. Apparatus according to claim 1, wherein at least one longitudinal wall of the pair of longitudinal walls comprises a structural stiffener made in a single piece with said wall, the stiffener comprising a folded portion of a sheet forming at least part of said wall.

9. Apparatus according to claim 1, wherein the at least one pair of transverse walls and the apparatus body comprise a guide of the excavation tool in various adjustment positions of an excavation depth of the excavation tool, said guide comprising a pair of lateral guides associated with the at least one pair of transverse walls or with the apparatus body delimiting a sliding space between the at least one pair of transverse walls, and a sliding member associated with the apparatus body or to the at least one pair of transverse walls, housed at least partly in the sliding space in a sliding manner.

10. Apparatus according to claim 9, wherein the sliding member is connected to the apparatus body and has a substantially annular shape.

11. Apparatus according to claim 9, wherein an outer annular surface of the sliding member is in abutment with said lateral guides and wherein an inner annular surface of said sliding member forms a rotational guide for said excavation tool.

12. Apparatus according to claim 1, wherein the self-leveling body and the apparatus body are rotatable parallel to the rotation axis.

13. Apparatus according to claim 1, wherein the excavation tool is rotatable with respect to the apparatus body by a motor, said motor being engaged with, and being movable integrally with, the excavation tool in different adjustment positions of an excavation depth.

14. Apparatus according to claim 1, wherein a position of the pair of abutment runners with respect to the excavation tool is adjustable in a mutually dependent manner.

15. Excavation assembly comprising:

an operating machine; and an excavation apparatus, according to claim 1, attached to a movable arm or to a support of the operating machine.

* * * * *